United States Patent [19]

Middleton et al.

[11] Patent Number: 4,718,830

[45] Date of Patent: Jan. 12, 1988

[54] BEARING CONSTRUCTION FOR REFRIGERATION COMPRESSSOR

[75] Inventors: Marc G. Middleton, Wyoming, Mich.; Richard T. Nelson, Worthington, Ohio

[73] Assignee: White Consolidated Industries, Inc., Cleveland, Ohio

[21] Appl. No.: 431,024

[22] Filed: Sep. 30, 1982

[51] Int. Cl.[4] ..... F04B 35/04; F04B 39/02

[52] U.S. Cl. ..... 417/372; 417/415; 417/902

[58] Field of Search ..... 417/366, 365, 372, 902, 417/415

[56] References Cited

U.S. PATENT DOCUMENTS

| | | | |
|---|---|---|---|
| 2,668,004 | 2/1954 | Browne | 417/415 |
| 3,465,953 | 9/1969 | Shaw | 417/368 |
| 3,606,594 | 9/1971 | Lewis et al. | 417/415 |
| 4,181,474 | 1/1980 | Shaw | 417/372 |

*Primary Examiner*—William L. Freeh

*Attorney, Agent, or Firm*—Pearne, Gordon, McCoy & Granger

[57] ABSTRACT

A hermetic refrigeration compressor has a cylinder block and a crankshaft rotatable about a vertical axis to reciprocate a piston in a cylinder on the cylinder block. A separate bearing housing is secured to the central portion of the cylinder block and extends vertically along the crankshaft, where it carries a pair of roller bearings to journal the crankshaft. The crankshaft has a radially extending flange which is journaled by a thrust-type roller bearing above the bearing housing to absorb the vertical forces on the crankshaft so that all three of the roller bearings are between the crankshaft and the bearing housing to maintain and control the close tolerances required by such bearings.

10 Claims, 4 Drawing Figures

BEARING CONSTRUCTION FOR REFRIGERATION COMPRESSSOR

The U.S. Government has rights in this invention pursuant to Contract No. W-7045-Eng-26 awarded by the U.S. Department of Energy.

BACKGROUND OF THE INVENTION

This invention relates generally to hermetic refrigeration compressors, and more particularly to small high-efficiency compressors utilizing rolling element bearings.

Household appliances, such as refrigerators and food freezers, almost universally use small hermetic compressors, many of which employ a single reciprocating piston driven by a crankshaft and connecting rod and driven by a two-pole electric motor at a nominal speed of 3600 rpm. The particular nature of this application for the compressor results in many problems in trying to increase the overall energy efficiency of the refrigerator unit. While a considerable increase in efficiency can be obtained by a more efficient insulation of the cabinet and sizing and design of condensers and evaporators, the hermetic compressor is still an area where substantial increases in operating efficiency can be obtained. The refrigeration compressor tends to be inefficient for a number of reasons, including such factors as the requirement of far more torque under start-up conditions than during normal run conditions and the requirement of a motor size that tends to become less efficient and operates at a lower power factor under normal run conditions in order to operate and give proper performance under other conditions such as start-up and low voltage. Likewise, because such compressors tend to be of relatively low displacement as compared to compressors used in other areas such as air conditioning and the like, where higher outputs are required, such compressors tend to have a lower mechanical efficiency, and therefore proportionally greater start-up and running friction in the bearings.

For reasons of compactness of size, as well as obtaining proper lubrication and physical simplicity, such single piston compressors utilize a crankshaft rotating about a vertical axis with a horizontally moving piston that may be located either at the top or the bottom of the compressor housing, and therefore either above or below the motor stator. With this arrangement, the crankshaft is usually supported on two axially spaced bearings which are positioned in regard to the forces acting on the crank from the motor, the location of the stator, and the position of the eccentric or crank pin which, through a connecting rod, reciprocates the piston. Because the crankshaft is vertical, it requires a form of thrust bearing to take the vertical weight of the crankshaft and motor rotor. To provide lubrication, it is conventional to have the lower end of the crankshaft extend into the body of lubricating oil in the bottom and, by virtue of having vertical passages offset from the axis of rotation, centrifugal force is used to cause the oil to flow upwardly in the crankshaft and provide suitable lubrication for all of the bearings and the piston and connecting rod.

The bearings for these compressors have generally been of the plain sleeve type because such bearings are low in cost, give long life, and are relatively quiet when the compressor is in operation. However, such bearings tend to produce high friction loads under certain operating conditions and during start-up, particularly when the compressor has not been operating for a long time and there may be an insufficient amount of lubricating oil on the bearing surfaces. When consideration has been given to the use of ball or roller bearings in these small compressors, problems have been encountered because of the high cost of such bearings as compared to plain sleeve bearings and the increased space requirements for their bearings may increase the overall compressor size. While such bearings reduce both the static and dynamic friction under start-up and running conditions, their life tends to be erratic because of the high degree of precision required in mounting the bearings, and such bearings tend to be somewhat noisy in operation. As a result of these factors, such rolling element bearings have not been used in small hermetic compressors of the type used for household refrigerators and food freezers.

SUMMARY OF THE INVENTION

The present invention provides an improved hermetic refrigeration compressor having improved mechanical efficiency resulting from a decrease in the friction of the crankshaft bearings. These bearings are provided by a pair of spaced, radial drawn-cup needle bearings which run directly on the crankshaft. The vertical loads on the crankshaft are provided by a radial needle thrust bearing mounted adjacent the upper radial bearing and all three of these bearings are mounted on a single bearing cartridge and engage directly with bearing surfaces on the crankshaft to provide positive alignment and tolerance control. The bearings are lubricated by a conventional centrifugal type oil pump which forces oil vertically upwards in an oil passage. Various passages are provided to direct the oil into the area adjacent the needles themselves, while additional oil goes up to the crank pin bearing and, through the connecting rod, to the piston and wrist pin. Since all of these passages are effectively closed at the bearing areas, all of the oil pumped upwardly by the centrifugal oil pump reaches the bearings which require lubrication.

In order to control the oil flow to ensure against excessive leakage from the needle bearings, particularly the radial bearings on the crankshaft, these bearings are in the form of the drawn cup type having a relatively thin outer race with uncaged needles. The drawn cups extend around each end of the needles to hold them in place, and also extend closely adjacent the crankshaft itself to minimize the clearance space which results in leakage of the oil out of the bearing. By thus controlling the oil leakage, a supply of adequate oil to the bearings is assured at all times.

Another feature of this invention is the fact that all of the bearings for the crankshaft are located on a single member so that the tolerances between the separate bearings can be closely held. This bearing member is then securely mounted on the main frame member, which includes the cylinder block and which serves as the mounting location for the motor stator member to ensure proper concentricity between the rotor which is pressed onto the crankshaft and the stator to ensure uniformity of the air gap. By having the bearing member extend from a point adjacent the crank pin on the crankshaft to the rotor on the crankshaft, the two radial bearings can be spaced an axial distance apart sufficient to eliminate any requirements for a bearing on the outer end of the crankshaft beyond the crank pin or at the other end beyond the rotor. This alignment is further aided by the fact what such needle bearings, unlike sleeve bearings, which must allow space for an oil film, run with reduced clearances to eliminate any cocking or tilting of the crankshaft in the bearings. Since these bearings are of relatively low cost construction, they add very little to the cost of the compressor as compared to ordinary sleeve bearings, yet they substantially reduce both the static and running friction on the crankshaft, which not only increases the operating efficiency of the compressor but results in lower heating loads within the compressor as a result of bearing friction.

DESCRIPTION OF THE PREFERRED EMBODIMENT

Figure 1:
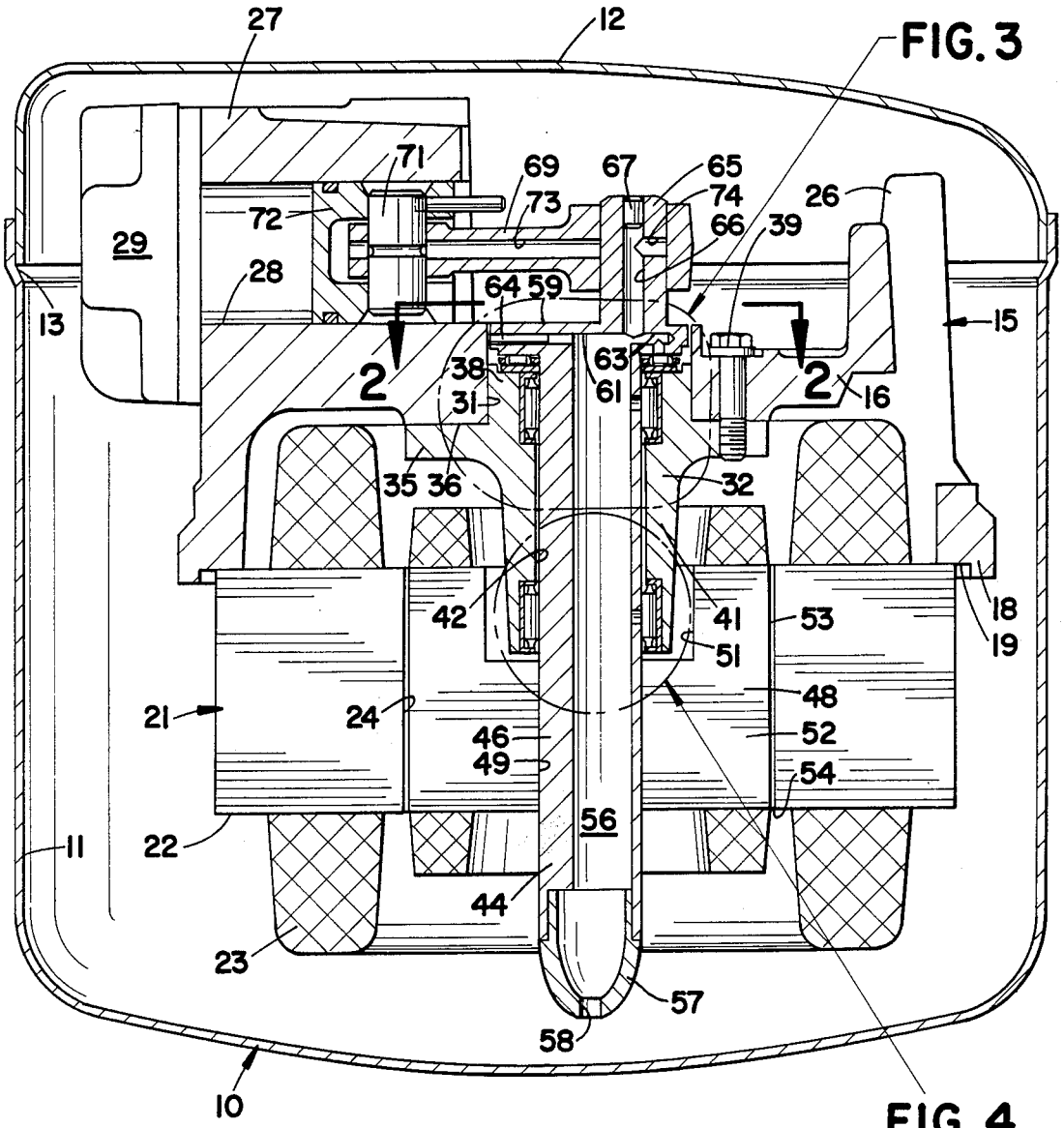
FIG. 1 is a vertical, cross-sectional view through a hermetic refrigeration compressor showing the bearing structure of the present invention.

Referring to the drawings in greater detail, FIG. 1 shows an elevational cross-sectional view through a hermetic refrigeration compressor incorporating the bearing arrangement of the present invention. The hermetic compressor includes the usual sheet metal shell 10 comprising a cuplike lower portion 11 and an upper portion or cover 12 which are joined together along a seam 13 by suitable means such as welding.

Within the shell 10 is mounted a cylinder block 15 which is normally resiliently supported within the shell by mounting springs (not shown) which may be secured either to the bottom or the sidewalls of the shell in the well known manner. The cylinder block is preferably a casting formed either of cast iron or aluminum, and also serves as the basic structural member to which various other parts, including all of the moving parts of the compressor, are secured. Thus, the cylinder block 15 generally includes a horizontally extending, centrally located web portion 16 extending in a horizontal plane around the central vertical axis of the cylinder block. The cylinder block also has around its outer, lower periphery a depending skirt 18 which defines a flange surface 19 to which the motor stator 21 is secured by suitable means such as machine bolts. The stator 21 includes a plurality of steel laminations 22 which are bolted to the flange surface 19, together with suitable windings 23 comprising the field windings of the motor. The laminations 22 also define a central bore 24 which, by virtue of the alignment of the laminations 22 and their mounting on the flange surface 19, define a cylinder coaxial with the vertical axis of the compressor.

The cylinder block 15 may also include suitable reinforcing ribs as shown at 26 to provide additional stiffness against any flexing or bending forces, and on one side carries a cylinder housing portion 27 within which is located the cylinder 28 which is closed off at the outer end by a suitable cylinder head 29 containing the necessary valving and manifold passages for connection with the cylinder 28. It will be understood that preferably the cylinder 28 has an axis that is horizontal and makes a perpendicular intersection with the axis defined by the central bore 24.

The central web 16 of cylinder block 15 has formed therein a bore or opening 31, also coaxial with the central bore 24, and which serves to mount a bearing housing 32. The bearing housing 32 has an axial portion 38 which fits within the bore 31, at the lower end of which is a radially extending flange 35 which seats against a suitable surface 36 on the lower side of central web portion 16. Suitable bolts 39 extend through openings in the central web 16 and make threaded engagement with the flange 35 to hold the bearing housing 32 rigidly in position with respect to the cylinder block 15. The bearing housing 32 also includes a tubular lower extension portion 41 which extend downward to a point below the cylinder block depending skirt 18, and within this lower extension 41 is a vertical axial bore 42 which is concentric with the stator central bore 24.

The crankshaft 44 is mounted within bearings in the bearing housing 32, as will be described in greater detail hereinafter. The crankshaft 44 has a cylindrical outer surface 46 slightly smaller than the bore 42 in bearing housing 32, and the crankshaft 44 extends downward below the bearing housing 32, where it fits within a bore 49 formed in the rotor 48 with a sufficiently tight fit to avoid any axial rotational movement between the rotor and the crankshaft while the compressor is operating. As shown in FIG. 1, the rotor 48 has laminations 52, and at the upper end above the bore 49 is an enlarged recess 51 in these laminations to receive the lowermost portion of bearing housing extension 41 to avoid any interference therebetween. The laminations 52 also have a cylindrical outer periphery 53 which is slightly smaller than the stator central bore 24 to define an air gap 54 therebetween.

Extending axially within the crankshaft 44 is an eccentric oil passage 56 which, at its lower end, communicates with an oil pump member 57. In accordance with usual practice, the oil pump member 57 is submerged below the oil level in the lower shell member 11 and enters through a centrally located hole 58. The centrifugal forces provided by the high speed of the rotating crankshaft 44 cause the oil to move radially outward along the inner surface of the pump member 57 and then flow upwardly through the oil passage 56. Directly above the axial portion 38 of bearing housing 32, the crankshaft 44 has an integral, radially extending flange 59, and the oil passage 56 terminates at an end wall 61 within the flange 59. A cross passage 63 extends transversely through the flange 59 and at the one end is closed off by a plug 64. An eccentric crank pin 65 projects upwardly from the flange 59 parallel to the axis of the crankshaft 44 and offset from that axis a distance which determines the piston stroke and displacement of the compressor. The crank pin 65 has a central oil passage 66 which at its lower end opens into the cross passage 63 and whose upper end is closed off by a plug 67. A connecting rod 69 has one end journaled on the crank pin 65, with the other end journaled on a wrist pin 71 mounted in a piston 72 slidably carried in the cylinder 28. The connecting rod 69 has an oil passage 73 extending from end to end therein and a side passage 74, and the crank pin 65 conducts oil from the passage 66 into the connecting rod oil passage 73, where the oil can flow upward to lubricate the wrist pin 71 in the conventional manner. Generally, the oil passages in the crankshaft 44 conform to usual practice in compressor design, with the exception of the plug 67 in the upper end of the upper oil passage 66. In many applications, a spray tube is mounted at this point so that excessive oil can be thrown around the upper part of the compressor for cooling purposes, but in accordance with the present invention this is not done and the passage is sealed so that all of the oil entering through the oil pump member 57 is available for lubrication of the various bearing surfaces.

Figure 3:
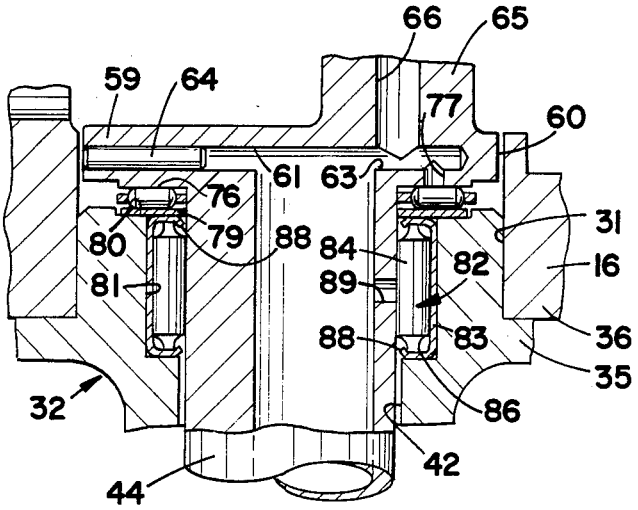
FIG. 3 is an enlarged, fragmentary, cross-sectional view through the upper bearing, as indicated on FIG. 1.
Figure 4:
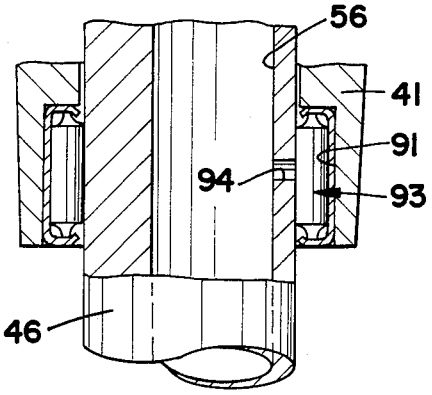
FIG. 4 is an enlarged, fragmentary, cross-sectional view through the lower bearing, taken in the area indicated on FIG. 1.

The details of the bearing arrangement by which the crankshaft 44 is mounted on the bearing housing 32 are shown in greater detail in FIGS. 3 and 4. The lower surface 76 of the crankshaft flange 59 forms a radially extending, annular bearing race surface which rests on a needle thrust bearing 78, which comprises a plurality of needle rollers mounted in a flat cage and may be constructed in accordance with the teachings of U.S. Pat. No. 2,724,625, issued Nov. 22, 1955. The thrust bearing 78 in turn bears against a hardened thrust washer 79, which fits within a recess 80 on the upper end of the bearing housing 32. Oil is supplied to the needle thrust bearing 78 through an oil passage 77 which extends from the lower flange surface 76 into the cross passage 63. It will be noted that the flange 59 has a cylindrical outer periphery 60 which fits within the bore 31 in the cylinder block center web 16 with a minimum of clearance. Because of this arrangement, very little of the oil supplied through the oil passage 77 to the needle thrust bearing 78 escapes through the gap between the outer periphery 60 and bore 31 to ensure positive lubrication and a plentiful oil supply at all times.

Directly below the recess 80, the bearing housing 32 has a cylindrical counterbore 81 to mount the upper radial bearing 82. The bearing 82 is a caged drawn cup needle roller bearing having a bearing cup 83 formed of relatively thin steel having a high surface hardness and which is a press fit within the counterbore 81. Within the bearing cup 83 are a plurality of rollers 84 which are positioned by means of a suitable cage and confined against lateral movement by the side flanges 86 of the drawn cup 83. It will be noted that the side flanges 86 terminate in inturned lips 88 immediately adjacent the outer surface 46 of crankshaft 44 to provide a minimum clearance at this point. An oil passage 89 extends from the eccentric passage 56 radially outward to supply oil within the upper bearing 82 at a location substantially midway between the side flanges 86 and because of a relatively small clearance between the inturned lips 88 and the crankshaft outer surface 46, minimal oil leakage at this point ensures adequate lubrication. Furthermore, oil loss from this bearing is limited by the fact that upward flow must be past the needle thrust bearing 78, while flow in a downward direction passes through the relatively tight clearance between the crankshaft outer surface 46 and the bore 42 in the bearing housing 32.

The lower end of bearing housing 32 has another counterbore 91 within which is mounted a lower bearing 93, which preferably is identical in construction with the upper bearing 82. Lower bearing 93 is also lubricated by oil from an oil passage 94 extending from the eccentric oil passage 56 into the bearing itself. Although oil can flow downward from the bearing past the lower inturned lip of the bearing cup of lower bearing 93, it is noted that the oil passage 94 will have the largest supply of oil, since it is the first oil passage out of the eccentric passage 56 above the oil pump member 57.

It is noted that the rollers in both the upper bearing 82 and lower bearing 93 run directly on the outer surface 46 of crankshaft 44. For this reason, the crankshaft 44 is preferably made of a suitable grade of steel that can either be case-hardened or otherwise surface-hardened to the high degree of hardness needed for long life of the bearings. Because of the arrangement of the three bearings all being mounted on the separate bearing housing 32 and running on the crankshaft 44, it is possible to maintain very close tolerances to ensure the proper running clearances for these bearings for maximum life and minimum noise. Furthermore, because the chances for oil to escape from these bearings is minimized, since oil can escape only from the lower bearing 93 or through the gap between the crankshaft flange periphery 60 in the bore 31, proper oil lubrication of the bearings is ensured at all times when the compressor is running.

Figure 2:
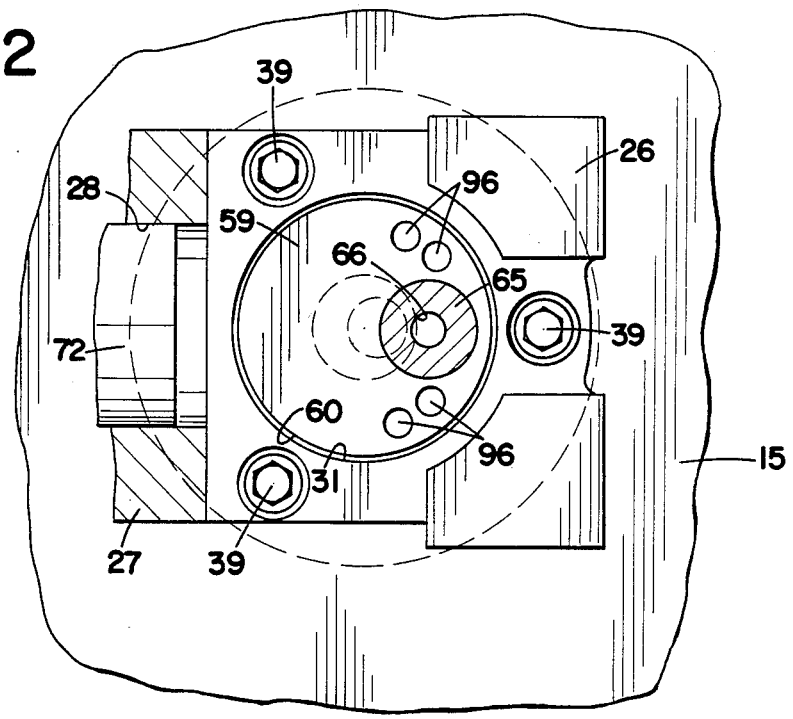
FIG. 2 is a fragmentary, cross-sectional view, taken on line 2—2 of FIG. 1.

Another advantage of this arrangement is that if desired on assembly, since all of the bearing clearances are determined by the machining of the bearing housing and crankshaft alone, the mounting of the bearing housing in the cylinder block can be allowed to shift a small amount if desired to ensure proper concentricity of the air gap 54 between the rotor and stator. Thus, during assembly it is possible that the bearing housing 32 may be made to have a clearance fit of the axial portion 38 within the bore 31 so that the bearing housing may be shifted laterally to ensure the proper uniformity of the air gap 54 before the bolts 39 are tightened to hold the bearing housing 32 securely in place on the cylinder block center web 16. It should also be noted that, while the design of the crankshaft 44 does not provide for and counterweights, it is still possible to obtain proper static balance of the crankshaft with regard to the offset of the crank pin 65 by virtue of the fact that the eccentric oil passage 56 can be varied somewhat in size and position. Furthermore, if further lightening is required, balance holes 96, as shown in FIG. 2, can be placed in the flange 59 on either side of the crank pin 65 without otherwise affecting the operation of the bearings and their lubrication.

Although the preferred embodiment of the present invention has been shown and described, it should be understood that various modifications and rearrangements may be resorted to without departing from the scope of the invention as defined in the claims.

What is claimed is:

1. A hermetic refrigeration compressor comprising a shell, a cylinder block mounted in said shell, a stator mounted on said cylinder block, piston and cylinder means on said cylinder block, a crankshaft operable to reciprocate said piston in said cylinder, a rotor secured to said crankshaft concentric with said stator, and bearing means for journaling said crankshaft for rotation about a vertical axis, said bearing means including a bearing housing, means securing said bearing housing to said cylinder block, said bearing housing having an axial bore to receive said crankshaft, said bearing housing carrying a pair of axially spaced rolling element bearings in said bore to journal said crankshaft, a flange on said crankshaft, and a rolling element thrust bearing between said flange and said bearing housing whereby all bearings for said crankshaft are positioned between said crankshaft and said bearing housing, the rolling elements of all of said bearings rolling directly on surfaces of said crankshaft, said crankshaft including an axially extending oil passage and separate oil passages connecting said axially extending oil passage to the surfaces of said crankshaft adjacent each bearing, said axially spaced bearings being drawn cup bearings having caged rollers therein and said drawn cups being non-rotationally secured to said bearing housing.

2. A hermetic refrigeration compressor as set forth in claim 1, wherein said drawn cups have radially extending side flanges extending adjacent said crankshaft surface to control leakage of oil from said bearings.

3. A hermetic refrigeration compressor as set forth in claim 2, wherein said thrust bearing comprises a plurality of radially extending rollers carried in a cage and a thrust washer carried on said bearing housing.

4. A hermetic refrigeration compressor comprising a shell, a cylinder block mounted in said shell and having a horizontally extending center web, a stator secured to said cylinder block below said center web, a piston and cylinder on said cylinder block above said center web, a central opening in said center web, a bearing housing secured to said cylinder block in said central opening, said bearing housing extending downwardly below said central web and having a vertical axial bore therein, a crankshaft in said vertical bore, a rotor secured on said crankshaft below said bearing housing, a pair of rolling element bearings carried by said bearing housing and spaced axially apart at the upper and lower ends of said vertical bore to journal said crankshaft, a flange on said crankshaft above said bearing housing, a crank pin on said crankshaft above said flange and operable to reciprocate said piston in said cylinder, and a rolling element thrust bearing positioned between said crankshaft flange and the upper end of said bearing housing whereby all bearings for said crankshaft are carried by said bearing housing, said rolling elements of all of said bearings rolling directly on surfaces of said crankshaft, said crankshaft including a main oil passage extending parallel to but offset eccentrically from the axis of said crankshaft and separate oil feed passages connecting said main oil passage to the surfaces of said crankshaft at each of said bearings, said pair of rolling element bearings being drawn cup bearings pressed into said bearing housing and including radially extending side flanges extending adjacent said crankshaft surface to control leakage of oil from said bearings.

5. A hermetic refrigeration compressor as set forth in claim 4, wherein said rotor has an annular recess at the upper end around said crankshaft and said bearing housing extends downwardly within said recess.

6. A hermetic refrigeration compressor as set forth in claim 4, wherein said bearing housing has a radial flange abutting the undersaid of said center web to position said bearing housing axially with respect to said cylinder block.

7. A hermetic refrigeration compressor as set forth in claim 6, wherein said bearing housing has an axial portion extending into said central opening to position said bearing housing radially with respect to said cylinder block.

8. A hermetic refrigeration compressor as set forth in claim 7, including a plurality of bolts adapted to clamp said radial flange against said center web.

9. A hermetic refrigeration compressor as set forth in claim 4, wherein said thrust bearing comprises a plurality of radially extending rollers carried in a cage and a thrust washer carried on said bearing housing above the upper of said pair of bearings.

10. A hermetic refrigeration compressor as set forth in claim 9, wherein said thrust bearing is positioned below the upper end of said central opening in said center web and said crankshaft flange has a peripheral surface extending adjacent the surface of said central opening to limit leakage of oil from said thrust bearing.

* * * * *